United States Patent [19]

Sivertz et al.

[11] 3,963,842

[45] June 15, 1976

[54] DEPOSITION OF COPPER

[75] Inventors: Christian Sivertz, London, Canada; Anthony J. Basilone, Guilford, Conn.

[73] Assignee: London Laboratories Limited Co., Woodbridge, Conn.

[22] Filed: Nov. 6, 1974

[21] Appl. No.: 521,338

Related U.S. Application Data

[63] Continuation-in-part of Ser. No. 481,332, June 20, 1974, abandoned.

[52] U.S. Cl. ..... 427/305; 427/304; 427/306; 427/426; 427/437; 106/1

[51] Int. Cl.[2] ..... B05D 3/04; B05D 3/10

[58] Field of Search ..... 117/35 S, 105.5, 130 E, 117/160 R; 106/1; 427/305, 304, 306, 437, 426, 168, 169

[56] References Cited

UNITED STATES PATENTS

| | | | |
|---|---|---|---|
| 2,759,845 | 8/1956 | Hilemn | 117/105.5 |
| 2,783,193 | 2/1957 | Nieter | 117/35 S |
| 2,900,274 | 8/1959 | Whitehurst | 117/35 S |
| 2,922,737 | 1/1960 | Moudry et al. | 117/35 S |
| 2,963,383 | 12/1960 | Weinrich | 117/105.5 |
| 2,967,112 | 1/1961 | Kay et al. | 117/105.5 |
| 2,977,244 | 3/1961 | Kay et al. | 117/105.5 |
| 3,093,509 | 6/1963 | Wein | 117/160 R |
| 3,403,035 | 9/1968 | Schneble, Jr. et al. | 106/1 |
| 3,615,732 | 10/1971 | Shipley, Jr. et al. | 117/160 R |
| 3,645,749 | 2/1972 | Paunovic | 117/160 R |

*Primary Examiner*—Michael F. Esposito
*Attorney, Agent, or Firm*—DeLio and Montgomery

[57] ABSTRACT

This invention relates to processes and compositions for the deposition of metallic copper on a catalytically activated surface by the controlled disproportionation of cuprous ions. Cupric tetraammino ions in aqueous solution are rapidly reduced to cuprous diammino ions and the latter are acted upon by the addition of an activator-modifier so as to bring about controlled disproportionation resulting in the deposition of metallic copper principally on the catalytically activated surface of a workpiece.

13 Claims, No Drawings

DEPOSITION OF COPPER

This application is a continuation-in-part of our United States application Ser. No. 481,332, filed June 20, 1974 now abandoned and titled "Electroless Deposition of Copper."

The present invention is directed to the deposition of copper and more particularly to the novel processes and compositions for the deposition of metallic copper on a catalytically activated surface by the controlled disproportionation of cuprous ions.

BACKGROUND OF THE INVENTION

In the production of mirrors, a film of silver is formed on one surface of a glass sheet and thereafter a coating or film of copper is formed on top of the silver film, prior to painting the copper film.

A variety of prior art processes, procedures, methods and techniques have been used to form the copper film but each of these prior art processes has substantial drawbacks. One prior art process involves the electrolytic deposition of copper from a suitable solution but this is no longer used for the production of mirrors due to the considerable technical difficulties which resulted in serious flaws and the like.

Accordingly, one of the most commonly used prior art procedures for the deposition of copper on mirrors, silver and the like is the process commonly referred to as the galvanic process and it employs the use of metallic powder as a reducing agent. The major drawback, however, to this galvanic process lies in the difficulty of maintaining a uniform aqueous suspension of the metallic powder which results in serious clogging of the spray guns and apparatus used in the process.

Still another prior art process for the deposition of a copper film on a silver surface or the like is that set forth in U.S. Pat. No. 2,977,244. According to one aspect of this prior art process, a cuprous diammino solution was initially prepared by reacting solid cuprous oxide with an excess of ammonium sulphate in the presence of free ammonia. The reaction according to this prior art process is represented by the following equation:

$$Cu_2O + (NH_4)_2SO_4 \rightleftharpoons 2Cu(NH_3)_2^+ + H_2O + SO_4= \qquad (1)$$

However, in this reaction according to the prior art patent, the formation of the cuprous diammino ions is very slow and requires a long time for the cuprous oxide to pass into solution while necessitating the constant stirring of the slurry which is exceptionally inert, especially towards the very weak acidic action of $NH_4+$. Still another disadvantage of this patented prior art process is the need to maintain the cuprous solutions used in this process in their reduced forms. Finally, the quality of copper films produced have been found to be inferior to those produced for example by other prior art processes including those discussed above.

SUMMARY OF THE INVENTION

In accordance with the present invention, the aforementioned deficiencies, disadvantages and difficulties of the prior art processes and procedures are overcome by a novel process for the deposition of copper metal on a catalytically activated surface such as silvered surfaces, conductive metallic surfaces, surfaces treated with suitable surface sensitizers such as stannous compounds, stannous-palladium colloids and the like.

The present invention provides processes and compositions for the deposition of metallic copper by rapidly reducing complex cupric ions substantially completely to cuprous ions. The cuprous ions are acted upon by the addition of an activator-modifier so as to bring about controlled disproportionation of the cuprous ions, thereby depositing metallic copper principally on the catalytically activated surfaces of the workpiece.

OBJECTS OF THE INVENTION

In view of the foregoing, it is an object of the present invention to provide a new and improved process for the deposition of metallic copper on catalytically activated surfaces by the controlled disproportionation of cuprous ions.

Another object of the invention is to provide for the use of cupric tetrammino ions which are rapidly reduced to cuprous diammino ions for use in the controlled disproportionation of cuprous ions.

Still another object of the invention is directed to the use of activator-modifiers to bring about controlled disproportionation of the cuprous ions.

A still further object of the invention is to bring about controlled disproportionation of cuprous ions efficiently and principally on a catalytically activated surface of the workpiece.

Other objects of the invention will in part be obvious and will in part appear hereinafter.

The invention accordingly comprises the several steps and the relation of one or more of such steps with respect to each of the others and to compositions which possess the characteristics, properties and the relation of the constituents employed in the process, all as exemplified in the detailed disclosure hereinafter set forth for which the scope of the invention will be indicated in the claims.

For a fuller understanding of the nature and objects of the invention, reference should be had to the following detailed description.

I. PREPARATION OF CUPROUS SOLUTIONS

The initial step which is involved in the present invention is the formation of complexed cuprous ions by the rapid reduction of complexed cupric ions in an aqueous solution.

The reduction step is carried out at such speeds as to be capable of supplying the necessary cuprous solutions needed for the deposition of copper on the surface of a mirror, workpiece, or the like which is moving on a conveyor line. By proceeding in this manner, it is not necessary to contend with the problems of storage and withdrawal of complexed cuprous solutions from pressure tanks operated under anaerobic conditions or otherwise to prevent oxidation of cuprous ions.

The reducing agents which are utilized in this step of the invention must be capable of reducing the complexed cupric ions substantially completely (but) only to complexed cuprous ions in a rapid fashion without substantial reduction to metallic copper. A class of reducing agents according to the present invention which possesses these desirable properties and which may be used alone, in admixture, or in admixtures with co-reducers comprises substances selected from nitrogenous materials containing one or two nitrogen atoms and having the formula:

$$X - NH - Y$$

wherein X is hydrogen, hydroxyl, hydroxyl-substituted lower alkyl or benzene sulfonyl groups and Y is $-NH_2$ or $NH_2.Z$.

If Y is $-NH_2.Z$, then X is hydrogen, hydroxyl-substituted lower alkyl or benzene sulfonyl and Z is an acid or —H or —H.Z. If Z however is —H.Z., then X is hydroxyl.

Specific members of this class of reducers which may be used in the present invention include hydrazine, salts of hydrazine with sulphuric acid or acetic acid, monosubstituted derivatives of hydrazine including 2-hydroxyethylhydrazine and p-hydrazino-benzene sulfonic acid, hydroxylamine, and salts of hydroxylamine with sulfuric acid or acetic acid.

As mentioned above, co-reducers may be used along with the above class of reducing agents and these include symmetrically disubstituted hydrazines, used along with the hydrazine members of the class of reducing agents discussed above, for example, di-2-hydroxyethylhydrazine, hydrazo benzene and hydrazo-carbonamide, and other nitrogenous materials, for example, aminoguanidine bicarbonate.

In the particular embodiment wherein 2-hydroxyethylhydrazine written as $R\text{-}NH\text{-}NH_2$, is the reducing agent, the reaction involved in the formation of a suitable solution of cuprous diammino iokns may be represented by the following equation:

$$R\text{-}NH\text{-}NH_2 + 3OH^- + 3Cu(NH_3)_4^{++} = 3Cu(NH_3)_2^+ + 6NH_3 + N_2 + 3H_2O + 1/2R_2 \quad (2)$$

The use of hydroxyl ammonium sulphate as the reducing agent may be preferred over hydroxyethyll hydrazine in view of the absence of nitrogen gas as a reaction product.

The formula for hydroxyl ammonium sulphate is $(NH_2OH)_2{:}H_2SO_4$. Upon dissolving this material in water the hydroxyl ammonium ion ($NH_3OH^+$) is formed which is very quickly neutralized in the basic ammonia solution, in accordance with the following equation:

$$NH_3OH^+ + NH_3 \rightleftharpoons NH_2OH + NH_4^+ \quad (3)$$

The reduction of the ammoniated cupric sulphate then is represented by the following equation:

$$2NH_2OH + 4Cu(NH_3)_4^{++} + 4OH^- = 4Cu(NH_3)_2^+ + 4H_2O + 8NH_3 + H_2N_2O_2 \quad (4)$$

The reaction as represented by equation (4) is very fast and the hyponitrous acid, $H_2N_2O_2$ may subsequently break down in accordance with the following equation:

$$H_2N_2O_2 = H_2O + N_2O \quad (5)$$

The latter reaction in Equation 5, however, is quite slow at room temperatures, so that when utilizing hydroxyl ammonium sulphate no nitrogen gas and very little nitrous oxide gas are produced over the period between formation and use.

The above mentioned procedure for formation of the cuprous diammino ion may be modified, if desired, by first forming an aqueous solution of the cupric salt and an acidic salt of the reducing agent, to provide a stable solution of pH about 3. Thereafter, a solution of ammonia of adequate strength is added, resulting in rapid reduction of tetraammino tetrammino ions to cuprous diammino ions.

II. ACTIVATOR-MODIFIER SOLUTIONS

The cuprous diammino ions according to the above preparations and procedures are acted upon by the addition of activator-modifiers such as, 1. a suitable amino composition, or
2. a suitable acid composition or
3. an acid composition in operation with
   i. a suitable anion in the acid composition, or
   ii. a suitable anion in the cuprous diammino solution, or combinations of (i) and (ii) so as to bring about controlled disproportionation.

When an amino activator-modifier is employed, the final pH is alkaline, that is, a pH higher than 7. The amino activator-modifier is primarily used in connection with applications where the copper film that is to be formed according to the instant invention is produced on a surface by immersion techniques rather than by spraying techniques. The reason for this is that in spraying technique applications, the metallic copper film can be redissolved by the ammonia formed in the presence of oxygen according to the following equation:

$$2Cu(NH_3)_2^+ + 2\ \text{amino} \rightleftharpoons Cu^0 + Cu(\text{amino})_2^{++} + 4NH_3 \quad (6)$$

Amino activator-modifiers that can be used in such applications must be chelating amines which bring about the controlled disproportionation of the cuprous ions. Examples of some such chelating amines are ethylene diammine, triethylene tetraamine, analogous alkyl amines, and the like.

When suitable acid activator-modifiers are used in bringing about the controlled disproportionation of the cuprous ions according to the instant invention, the acids are chosen so as to supply the requisite hydrogen ions to bring the terminal pH below 7 and to supply the appropriate anions to bring about metallic copper deposition, principally on the catalytically activated surface of the workpiece. Examples of such acids are: hydroxycarboxylic acids, such as tartaric, saacharic, citric and/or lactic acid, and the like; dicarboxylic acids, such as succinic acid, and the like; and sulfamic acid.

When, however, an acid activator composition is used in operation with i. a suitable anion modifier in the acid composition, or
ii. a suitable anion modifier in the cuprous diammino solution, the requisite hydrogen ions are supplied by a mineral acid such as sulfuric acid, phosphoric acid, or the like. Then the appropriate anion modifiers may be supplied by adding to such mineral acids or to the cuprous diammino solutions: hydroxy-carboxylic acids or their salts, such as the tartaric, saacharic, citric and/or lactic acids; dicarboxylic acids or their salts, such as succinic or itaconic; or sulfamic acid or the salts thereof.

The invention may be illustrated further by reference to the following examples:

EXAMPLE 1

Cuprous diammino ion solution (A1)

66g cupric sulphate pentahydrate were dissolved in 800ccs of deionized water. 110-ccs of 10-normal ammonia was added. In the substantial absence of oxygen, 9.2g of a solution of 80% 2-hydroxyethyl hydrazine and 20% di-2-hydroxyethyl hydrazine was added with stirring and the solution was made up into 1000ccs. with deionized water. The characteristic blue color of the cupric ions disappeared and the resulting solution was water white.

When the above reducer is employed, the anion necessary to bring about the catalytic deposition on the surface of the workpiece is added to the aqueous curpic sulphate pentahydrate solution in the amount of 20 grams of Rochelle salts or the like.

Solution (B1)

A liter of a second aqueous solution was made up containing 0.4 moles of sulphuric acid, 0.4 moles of sulphamic acid and 0.02 moles of tartaric acid.

5 ccs of each of solution (A1) and (B1) shortly after formation thereof were mixed together as they were swirled in a silvered glass beaker to bring about ther disproportionation of the activated cuprous ions with the resulting deposition of metallic copper on the catalytic surface of the beaker.

EXAMPLE 2

A glass plate was cleaned and sensitized with stannous salts and then washed and dipped in a 1% solution of palladium chloride. After draining and washing, the plate was subjected to two fan sprays of atomized solutions (A1) and (B1), prepared as described in Example 1 so that the sprayed solutions met substantially at the surface of the plate. A suitable film of metallic copper was deposited substantially instantaneously by disproportionation at the catalytically activated surface of the workpiece.

EXAMPLE 3

48ccs per minute of a solution containing 50 g/1 of hydroxylammonium sulphate was mixed with another solution flowing at a rate of 260ccs per minute. The latter solution contained 30ccs of 330 g/ 1 of cupric sulphate pentahydrate, sufficient ammonia to react with the copper to form cupric ammonium sulphate and the remainder water of dilution. Upon mixing the two solutions, a resulting colorless cuprous diammonium solution was formed with a total flow rate of 308ccs per minute. No gas formation was observed.

The cuprous solution then was pumped to a double tip airless spray gun and an equal quantity of 0.4M sulphuric acid which contained .2M Rochelle salts dissolved in it and was pumped to the other half of the same gun.

The gun tips were adjusted so that the cuprous and acid solutions met at the surface of freshly silvered glass. A copper film was immediately formed on the silvered surface and, after washing the copper film, it was observed to be smooth, continuous and substantially free from blemishes.

EXAMPLE 4

An aqueous solution containing 0.4M sulphuric acid and 0.4M sulphamic acid was prepared. A second solution was prepared in deionized water containing 66 g/1 of copper sulphate pentahydrate, 100cc/1 of 10 molar ammonia and 25 g/1 of hydroxylammonium sulphate. Upon preparation, the resulting cuprous diammonium sulphate solution was completely colorless.

Each solution then was placed in a separate aspirator bottle containing a tube attached to each side of a 2-nozzle air spray gun. Air pressure of 35 psi was used to achieve air atomization of the two solutions during spray from the gun. The two atomized streams were made to converge at the surface of freshly silvered glass panels. There resulted the immediate formation of a bright, continuous copper film of the silvered surface.

EXAMPLE 5

40 grams of cupric sulphate pentahydrate were dissolved in 500cc of deionized water, along with 60cc of 10 normal ammonia. 15 grams of hydroxyl-ammonium sulfate was added and the solution was made up to one litre. The solution was immediately colorless. A second solution was prepared which contained 50 grams per litre of ethylene diammine in water. 10cc of each solution were introduced into a silvered glass beaker and mixed. After sitting for 2 minutes, the reacted solution was poured out. A smooth, bright copper film was observed on the silver surface, and the reacted solution contained no sludge or precipitate.

EXAMPLE 6

An aqueous solution of 0.8M sulphamic acid was prepared. A second solution was prepared in deionized water containing 66 g/1 of copper sulphate pentahydrate, 100cc/1 of 10 molar ammonia and 25 g/1 of hydroxylammonium sulphate. Upon preparation, the resulting cuprous diammonium sulphate solution was completely colorless.

Each solution then was placed in a separate aspirator bottle containing a tube attached to each side of a 2-nozzle air spray gun. Air pressure of 35 psi was used to achieve air atomization of the two solutions during spray from the gun. The two atomized streams were made to converge at the surface of freshly silvered glass panels. There resulted the immediate formation of a bright, continuous copper film on the silvered surface.

It will thus be seen that the objects set forth above, among those made apparent from the preceding description are efficiently attained and since certain changes may be made in the carrying out of the process, in the compositions employed, and in the articles produced without departing from the scope of the invention, it is intended that all matter contained in the above description shall be interpreted as illustrative and not in a limiting sense.

It is also to be understood that the following claims are intended to cover all of the generic and specific features of the invention herein described and all statements of the scope of the invention which as a matter of language might be said to fall therebetween.

It is particularly to be understood that in the said claims, ingredients and compounds recited in the singular are intended to include compatible mixtures of such ingredients wherever the sense of the description permits.

What is claimed is:

1. In a process for the deposition of metallic copper on a catalytically activated surface by disproportionation of cuprous ions in an aqueous solution to effect deposition of metallic copper on said surface, the improvement which comprises rapidly reducing cupric tetraamino ions in aqueous solution substantially completely to cuprous diammino ions and thereafter effecting controlled disproportionation of the resultant cuprous ions by adding an activator-modifier, which activator-modifier brings about the deposition of metallic copper principally on said catalytically activated surface.

2. The process of claim 1 wherein said reduction of cupric tetraamino ions in aqueous solution is carried out using a nitrogenous material selected from the group consisting of hydrazine, salts of hydrazine with sulfuric acid, salts of hydrazine with acetic acid, 2-hydroxyethylhydrazine, di-2-hydroxyethylhydrazine, p-hydrazino-benzene sulfonic acid, hydrazo benzene, hydrazo-carbonamide, aminoguanidine bicarbonate, hydroxylamine, salts of hydroxylamine with sulfuric acid, salts of hydroxylamine with acetic acid and hydroxyl ammonium sulfate.

3. The process of claim 2 wherein said nitrogenous material is a hydroxyl ammonium salt.

4. The process of claim 3 wherein said hydroxyl ammonium salt is hydroxyl ammonium sulphate.

5. The process of claim 2 wherein said nitrogenous material is 2-hydroxyethylhydrazine.

6. The process of claim 1 wherein the activator-modifier is an alkylamine.

7. The process of claim 1 wherein said activator-modifiers are 1. chelating amines selected from the group consisting of ethylene diammine, triethylene tetraammine, and analogous alkylamines, or
2. suitable acids or salts selected from the group consisting of sulfamic acid, hydroxy-carboxylic acids, carboxylic acids and combinations thereof.
3. an acid activator selected from the group consisting of sulfuric and phosphoric acids used with modifiers selected from the group consisting of said suitable acids or salts, said chelating amines, and combinations thereof.

8. The process of claim 2 wherein said reduction of cupric tetraammino ions in aqueous solution is carried out by first forming ann aqueous solution of a cupric salt and one of said nitrogenous materials to form a stable acidic aqueous solution and thereafter adding ammonia to said stable acidic aqueous solution in sufficient quantity to achieve said reduction.

9. The process of claim 1 wherein the resulting aqueous solution of cuprous diammino ions are sprayed as a first stream onto a catalytically activated surface, and a second spray stream of said activator-modifier is sprayed onto the said catalytically activated surface to form with said first spray stream a thin aqueous film of intermixed streams, whereby the cuprous ions undergo disproportionation to form said metallic copper.

10. The process of claim 1 wherein the resulting aqueous solution of cuprous diammino ions together with a modifier are sprayed as a first stream onto a catalytically activated surface, and a second spray stream of said activator is sprayed onto the said catalytically activated surface to form with said first spray stream a thin aqueous film of intermixed streams whereby the cuprous ions undergo disproportionation to form said metallic copper.

11. In a process for the deposition of metallic copper on a catalytically activated surface by disporportionation of cuprous ions in an aqueous solution to effect deposition of metallic copper on said surface, the improvement which comprises effecting controlled disproportionation of the cuprous ions by adding an activator-modifier which activator-modifier brings about the deposition of metallic copper principally on said catalytically activated surface.

a. a chelating amine selected from the group consisting of ethylene diammine, triethylene tetraammine, and analogous alkylamines, or b. a suitable acid or salt selected from the group consisting of sulfamic acid, hydroxy-carboxylic acids, carboxylic acids, and combinations thereof; or c. an acid activator selected from the group consisting of sulfuric and phosphoric acids used with modifiers selected from the group consisting of said suitable acids or salts, said chelating amines, and combinations thereof.

12. In a process for the deposition of metallic copper on a catalytically activated surface by disproportionation of cuprous ions in an aqueous solution to effect deposition of metallic copper on said surface, the improvement which comprises rapidly reducing cupric tetraammino ions in aqueous solution substantially completely to cuprous diammino ions and effecting disproportionation of the resulting cuprous ions to bring about the deposition of metallic copper principally on said catalytically activated surface.

13. The process of claim 12 wherein said reduction of cupric tetraammino ions in aqueous solution is carried out using a nitrogenous material selected from the group consisting of hydrazine, salts of hydrazine with sulfuric acid, salts of hydrazine with acetic acid, 2-hydroxyethylhydrazine, di-2-hydroxyethylhydrazine, p-hydrazino-benzene sulfonic acid, hydrazo benzene, hydrazo-carbonamide, aminoguanidine bicarbonate, hydroxylamine, salts of hydroxylamine with sulfuric acid, salts of hydroxylamine with acetic acid and hydroxyl ammonium sulfate.

* * * * *